US006580520B1

(12) United States Patent
Teradaira et al.

(10) Patent No.: US 6,580,520 B1
(45) Date of Patent: Jun. 17, 2003

(54) PRINTING APPARATUS, A METHOD OF CONTROLLING THE PRINTING APPARATUS, A PRINTER CONTROL PROGRAM, AND A STORAGE MEDIUM FOR THE PROGRAM

(75) Inventors: Mitsuaki Teradaira, Shiojiri (JP); Atsushi Nishioka, Shiojiri (JP); Yuji Kawase, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/363,976

(22) Filed: Jul. 29, 1999

(30) Foreign Application Priority Data

Jul. 29, 1998 (JP) ..... 10-214594

(51) Int. Cl.[7] ..... B49B 15/00
(52) U.S. Cl. ..... 358/1.15; 347/20
(58) Field of Search ..... 358/1.1–1.18, 358/440; 703/522

(56) References Cited

U.S. PATENT DOCUMENTS 5,197,123 A * 3/1993 Nagata et al. ..... 707/522
5,379,061 A 1/1995 Yamaguchi et al.
5,442,774 A * 8/1995 Pickup et al. ..... 713/501
5,784,080 A 7/1998 Nitta et al.
6,038,375 A * 3/2000 Makino ..... 358/1.13
6,426,805 B1 * 7/2002 Imai et al. ..... 358/468

FOREIGN PATENT DOCUMENTS

| | | |
|---|---|---|
| EP | 0 442 438 | 8/1991 |
| JP | 62-248656 | 10/1987 |
| JP | 10-151836 | 6/1998 |

* cited by examiner

*Primary Examiner*—Edward Coles
*Assistant Examiner*—Saeid Ebrahimi

(57) ABSTRACT

A printer and methods of controlling the initialization process(es) of the printer according to the length of a reset signal sent from a host computer. The printer preferably has a printing mechanism for printing text or graphics based on commands and print data received from the host device, a controller for controlling printer operation including the execution of the initialization process(es), an interface for receiving at least one reset signal from the host device; and a timer circuit for measuring the duration of each reset signal. The controller controls which one, if any, of a plurality of specific initialization processes are to be performed based on the duration of a respective reset signal. By controlling the initialization process according to the duration, the printer can perform a reset operation appropriate to the status of the host.

31 Claims, 5 Drawing Sheets

PRINTING APPARATUS, A METHOD OF CONTROLLING THE PRINTING APPARATUS, A PRINTER CONTROL PROGRAM, AND A STORAGE MEDIUM FOR THE PROGRAM

BACKGROUND OF THE INVENTION

1. Field of the Invention

The present invention relates to a printing apparatus and methods for controlling initialization process(es) carried out by the printing apparatus. More particularly, the present invention relates to a printer and methods that select one or more particular printer initialization processes to be performed according to the time difference between the leading and trailing edges of the pulse of a reset signal sent from a host computer. The present invention further relates to a software program for implementing the methods and media on which the program is recorded or carried.

2. Description of the Related Art

A printer that performs a process initializing its printing mechanism when a reset signal is received from a host computer and methods for resetting such a printer are generally known. A printer that performs an initialization process every time it is switched on is also known.

A typical printer initialization process includes the following:

(a) adjusting the phase timing of the stepping motor for driving the print head in the print line direction;

(b) positioning the print head based on a reference position;

(c) cleaning the print head;

(d) initializing a command buffer and other memory areas; and (e) initializing certain printer settings, such as the form selection (slip or receipt forms, for example), font selection, print format (including character and line spacing), and printing mode (i.e., fine or normal).

Some of these initialization process steps require more time than others. For example, phase adjustment of the stepping motor (ensuring that a predetermined phase is excited) requires relatively little time, while print head positioning (synchronizing the actual position of the print head with data in a controller representing the position of the print head) and print head cleaning require more time.

The cleaning of the print head of an ink jet printer may be accomplished by drawing ink from the head and/or discharging it. In addition to being somewhat time consuming, this process also consumes ink. It is therefore desirable to avoid unnecessary cleaning operations as much as possible.

Conventional printers typically generate an interrupt at the leading edge of a reset signal, and perform all initialization processes at the trailing edge of the reset signal. Moreover, some applications that run on a host computer also send a reset signal to the printer every time the application starts up or at every printing transaction, thereby causing the printer to completely reinitialize at the end of every printing transaction. One problem with this arrangement is that it results in the execution of unnecessary initialization processes which, in turn, unnecessarily depletes the supply of consumables such as ink and also reduces printer throughput.

Consider, by way of example, a conventional point-of-sale (POS) system which runs a common application that sends a reset signal with every print transaction. With this arrangement, the print head cleaning operation is performed with every print transaction, thus consuming a large amount of ink. This greatly increases operating costs, and reduces the processing speed of each print transaction because of the lengthy period of time required for the initialization process.

OBJECTS OF THE INVENTION

It is therefore an object of the present invention to overcome the aforementioned problems.

In consideration of the above-described problems, another object of the present invention is to provide a printing apparatus and a method therefor that can select the appropriate initialization process(es) according to the time duration of a reset signal sent and also according to the needs of the host computer.

A further object of the present invention is to provide a program of instructions (i.e., software) for implementing the control methods of the invention and media on which the program is recorded or carried.

SUMMARY OF THE INVENTION

To achieve the above objects, a printing apparatus having a printing mechanism for printing text or graphics based on commands and print data received from a host device is provided. According to one aspect of the present invention, the printing apparatus comprises a controller that controls operation of the printing apparatus, an interface circuit adapted to receive a reset signal from the host device and transmit the reset signal to the controller, and a timer circuit that measures the duration of each of the reset signals received by the controller. The controller selects which one, if any, of a plurality of initialization processes is to be performed based on the duration of a respective reset signal.

Thus, a printer according to the present invention can select a specific initialization process according to the duration of a reset signal sent from a host device, where the duration is the time period between the leading and trailing edges of the reset signal. This enables the printer to perform an appropriate initialization and reset process given the present operating conditions.

The printing apparatus preferably comprises a comparator that compares the duration with at least one specific threshold time. In this case, the controller either determines that no initialization process is necessary or selects and causes one or more specific initialization processes to be performed based on the result of the comparison by the comparator.

Preferably, the controller causes a first initialization process to be performed when the duration is less than a first specific threshold time and causes a second initialization process to be performed when the duration is greater than or equal to the first specific threshold time.

Thus, in accordance with the present invention, because each specific initialization process need not be performed each time the printing apparatus receives a reset signal, printing throughput can be improved.

Preferably, the printing mechanism comprises a stepping motor, and the first initialization process includes a process for adjusting the phase of the stepping motor. When the printing mechanism comprises a print head, the first initialization process also preferably includes a process for synchronizing the actual position of the print head with data in the controller representing the position the position of the print head.

The printing apparatus further preferably comprises memory for storing at least one among various printing apparatus settings, a command from the host device, or print data. In this case, the first initialization process includes a process for clearing part or all of the memory.

When the print head is an ink jet type, the second initialization process preferably includes a process for cleaning the print head. In this case, the present invention can significantly reduce ink consumption by performing time consuming print head cleaning only when needed.

Preferably, the timer circuit comprises a real-time clock that measures time, and a delay circuit that delays the reset signal output from the interface circuit for a specific time and supplies the delayed reset signal to the controller. The controller performs the selected initialization process, which is one out of the plurality of initialization processes selected according to the duration, in response to the delayed reset signal.

According to another aspect of the present invention, the comparator compares the duration with two different threshold times (i.e., first and second specific threshold times). Based on this comparison, the controller causes a third initialization process to be performed when the duration (t) is less than the second specific threshold time (t1), causes the first initialization process to be performed when the duration is greater than or equal to the second specific threshold time and less than the first specific threshold time (t2), and causes the second initialization process to be performed when the duration is greater than or equal to the first specific threshold time.

The printing apparatus further preferably comprises memory for storing at least one among various printing apparatus settings, a command from the host device, or print data. In this case, the third initialization process includes a process for clearing part or all of the memory.

Also, in one embodiment using two different threshold times, the first initialization process may include processes for clearing part or all of the memory, adjusting the phase of the stepping motor, and synchronizing the print head; and the second initialization process may include these processes plus a process for cleaning the print head.

The present invention may also be embodied as a method of controlling a printing apparatus and in particular for selecting one or more specific initialization processes to be performed based on the reset time of a reset signal received by the printing apparatus from a host device. Such a control method, when carried out, achieves the same benefits as described above.

Such a control method may be implemented by a program of instructions (i.e., software) which may be embodied on a device-readable medium. The instructions may be supplied to the printing apparatus for execution by the controller. The device readable medium on which such a control program is recorded can be distributed or marketed as a software product separate from the printer with which the program is used. Running such a control program on a printer yields the abovedescribed benefits of the invention.

Some exemplary device readable media for storing the control program of the invention include CD-ROMs, floppy disks, hard disks, magneto-optical disks, DVD (digital video disk or digital versatile disk) media, semiconductor memories, and magnetic tape. Any of these or other suitable storage media can be used to introduce the control program of the invention to existing printing apparatuses.

Device readable media may also include a carrier wave in which the control program is embodied. In this form the control program can be transmitted via the Internet or other computer network from a remote location to a location where the printing apparatus resides for use by that printing apparatus. It is also possible to place this control program on a World Wide Web (WWW) site on the Internet so that users can download the program for introduction to and use with an existing printer. These and other variations are included within the scope of the present invention.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

The preferred embodiments of the present invention are described below with reference to the accompanying figures. These embodiments are descriptive of the present invention and not restrictive of the scope of the claims. As will be apparent to one skilled in the art any or all of the elements described below can be replaced by other equivalent structure to achieve the same effect. Such variations are considered to be included within the scope of the present invention.

Figure 1:
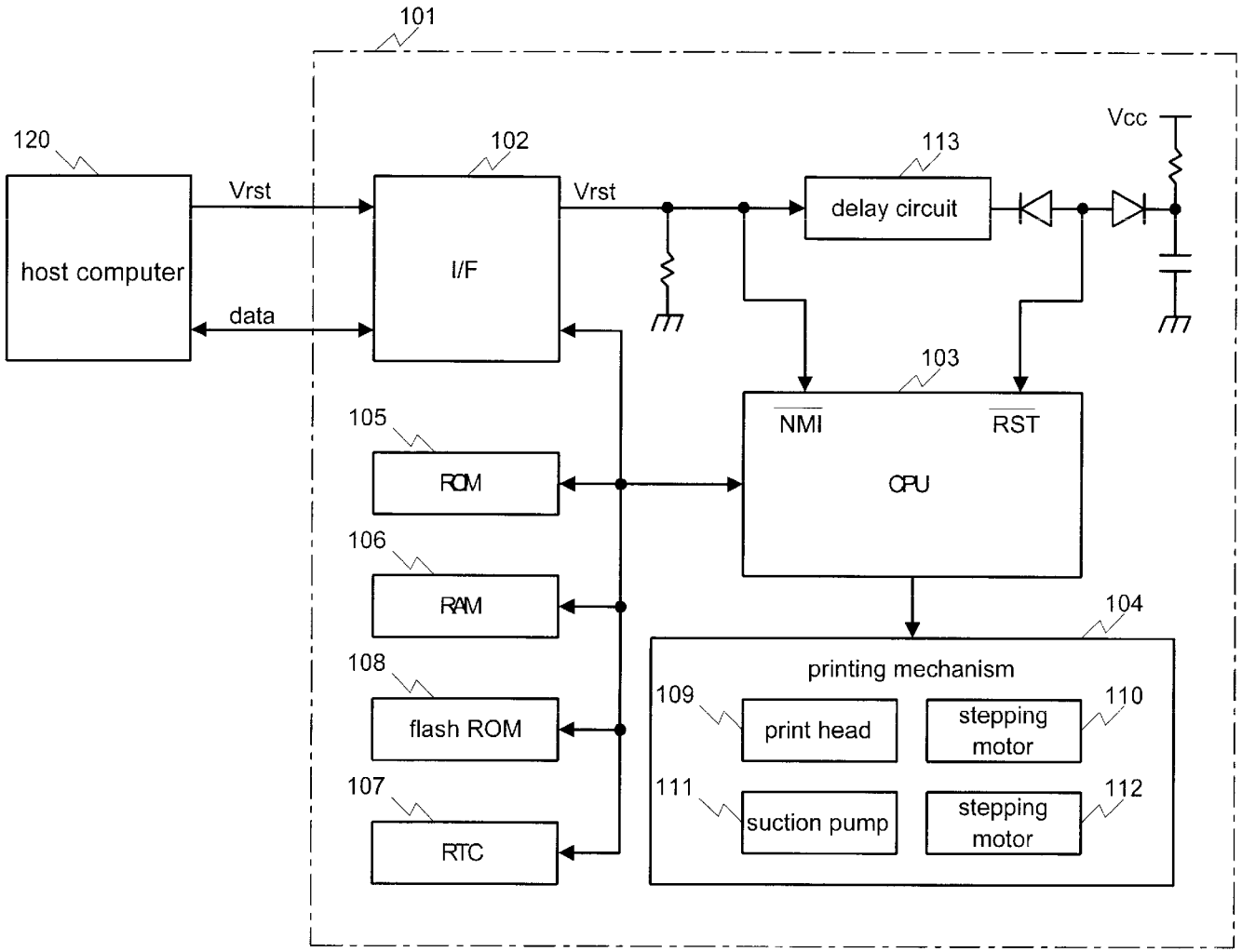
FIG. 1 is a block diagram of a printer according to an embodiment of the present invention.

Referring first to FIG. 1, a block diagram of a printing apparatus (i.e., a printer) 101 according to a preferred embodiment of the present invention is illustrated. Printer 101 receives print commands, print data, and other information sent from a host computer 120 through a printer interface 102. The received data is temporarily stored in a receive buffer, which is a certain area of Random Access Memory (RAM) 106. Printer 101 includes a Central Processing Unit (CPU) 103 that controls a printing mechanism 104 based on the commands and print data received through the interface 102 to print text and/or graphics on paper or other print medium.

In addition to issuing print commands for printing text or graphics, the host 120 also issues control commands including a reset command, as well as various printer setting commands for setting various parameters of printer 101.

In one embodiment of the invention, the processes (including the initialization processes described herein) performed by the CPU 103 are stored as one or more programs of instructions (i.e., software) in a processor readable medium such as a Read-Only-Memory (ROM) 105. When printer 101 power is turned on, the CPU 103 begins operating based on the program(s) stored in ROM 105. The CPU 103 first reads the program(s) from ROM 105 into a working memory such as RAM 106, and then executes the program (s) from RAM 106.

More broadly, the programs of instructions for implementing various aspects of the present invention may be conveyed by a variety of processor- or device-readable mediums including magnetic tape, magnetic disk, optical disc, or carrier waves such as baseband or modulated communication paths throughout the spectrum including from supersonic to ultraviolet frequencies. When embodied in one of these mediums the program(s) may be copied into RAM 106 for execution by the CPU 103.

Execution of such program(s) by the CPU 103 provides the printer 101 with the capability of dynamically controlling the initialization process, including determining if an initialization process is to be performed and, if so, which particular initialization process(es) are to be performed, as described more fully below.

The CPU 103 creates a representation of the text or graphic to be printed in the print buffer area of RAM 106, and uses this representation to drive the printing mechanism 104. The CPU 103 uses font data stored in ROM 105 to generate a representation of text to be printed based on the character code information as the print data received from the host 120.

A Real-Time Clock (RTC) 107 is provided for measuring or counting time in, for example, second units.

Flash ROM 108 is a type of nonvolatile memory, and is used for nonvolatile storage of various information. It will be apparent that static RAM (SRAM) with a backup battery or other types of memory can be alternatively used instead of a flash ROM.

The printing mechanism 104 has a print head 109, stepping motors 110 and 112, and a suction pump 111. Stepping motor 110 is for moving the print head 109 in a direction substantially perpendicular to the paper transport direction. Stepping motor 112 is for transporting the print medium along a transportation path in printer 101. The printer 101 may also have other stepping motors for such tasks as transporting an ink ribbon, and selecting the paper transportation path when two or more types of print media can be used. The print head 109 of this exemplary printer 101 is an ink jet head. The printer 101 therefore uses suction pump 111 to perform a cleaning process which involves suctioning ink that is left from a previous print transaction and also ink that has increased in viscosity from inside the print head 109.

In accordance with the invention, a reset signal Vrst issued by the host 120 is supplied through interface 102 to the interrupt signal input terminal of the CPU 103 in printer 101, enabling the CPU 103 to detect when it has received the reset signal. The reset signal Vrst is also supplied through interface 102 to a delay circuit 113 where Vrst is delayed a specific period of time and then applied to the reset terminal of the CPU 103. This delayed reset signal is referred to below as the internal reset signal Vr. When the CPU 103 is reset by this internal reset signal Vr, the CPU 103 controls the execution or performance of the initialization process as described below. The delay circuit 113 can be achieved by means of a timer or other circuit external to the CPU 103.

The reset signal Vrst is preferably supplied to a non-maskable interrupt (NMI) terminal of the CPU 103 whereby an interrupt can be asserted. Supplying the reset signal Vrst to the NMI terminal also enables reliable detection of Vrst as well as other externally generated reset signals. The internal reset signal Vr is preferably supplied to the reset terminal (RST) whereby the CPU 103 can be forcibly reset. With this arrangement, the CPU 103 can be reliably forced to reset in response to an external reset signal.

The CPU 103 uses the delay between when the reset signal Vrst is detected and when the internal reset signal Vr is detected to set and store in flash ROM 108 an external reset flag and the time that the reset signal Vrst was received by the CPU 103. This external reset flag indicates that a reset signal was received from the host 120 through interface 102 (as opposed to a reset signal generated, in response to a switching on of the printer 101, by the reset signal generator schematically shown in the upper right portion of FIG. 1). The receipt time of Vrst is obtained from the RTC 107. The delay circuit 113 must therefore delay Vrst long enough to assure that the external reset flag and receipt time from the RTC 107 can be stored.

The external reset flag and receipt time of the reset signal Vrst can be stored to volatile memory instead of nonvolatile memory. This is because the reset signal Vr simply resets the CPU 103 and does not prevent power from being supplied to the printer 101; memory content will, therefore, not normally be lost.

The various components of printer 101, such as interface 102, CPU 103, ROM 105, RAM 106, flash ROM 108, and RTC 107 are connected using a conventional bus or other known connection.

The RTC 107 functions in conjunction with the CPU 103, RAM 106 and flash ROM 108 as a timer circuit. As previously noted, the ROM 105 also functions as a medium in which a program may be recorded or stored for controlling the printer 101. Moreover, when a control program in ROM 105 is updated or replaced by program code conveyed from the host 120, such program code may be embodied on any of a variety of processor or device readable mediums as previously mentioned, such as a CD-ROM, hard disk, floppy disk, or other storage medium used by the host 120.

Figure 2:
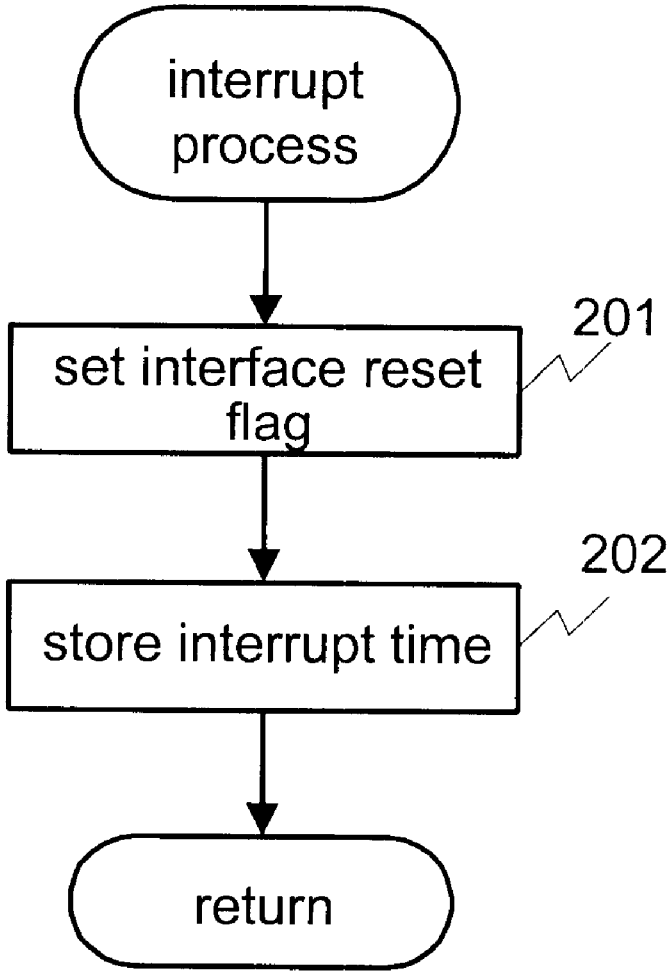
FIG. 2 is a flow chart illustrating a process performed by a printer when it receives a reset signal in accordance with the present invention.

FIG. 2 is a flow chart of an interrupt process performed when the CPU 103 receives a reset signal Vrst. This process starts when the host 120 sends a reset signal Vrst to the printer 101, and an interrupt is generated at the leading edge of the reset signal Vrst (see FIG. 4). When the reset signal Vrst from the host 120 is applied to the NMI terminal of the CPU 103, the CPU 103 sets the external reset flag to indicate that the reset signal Vrst was detected (step 201). The CPU 103 also obtains from the RTC 107 the time at which the leading edge of the reset signal Vrst was detected, that is, the time the reset signal was input to the NMI terminal, and stores this time in flash ROM 108 (step 202). These steps are performed in the time period between the time that the reset signal Vrst is detected at the NMI terminal and the time that the internal reset signal Vr, transmitted from the delay circuit 113, is detected at the RST terminal. Following this and in response to the internal reset signal Vr, the same initialization routine that is performed when the power to the printer 101 is turned on is then performed.

Figure 3:
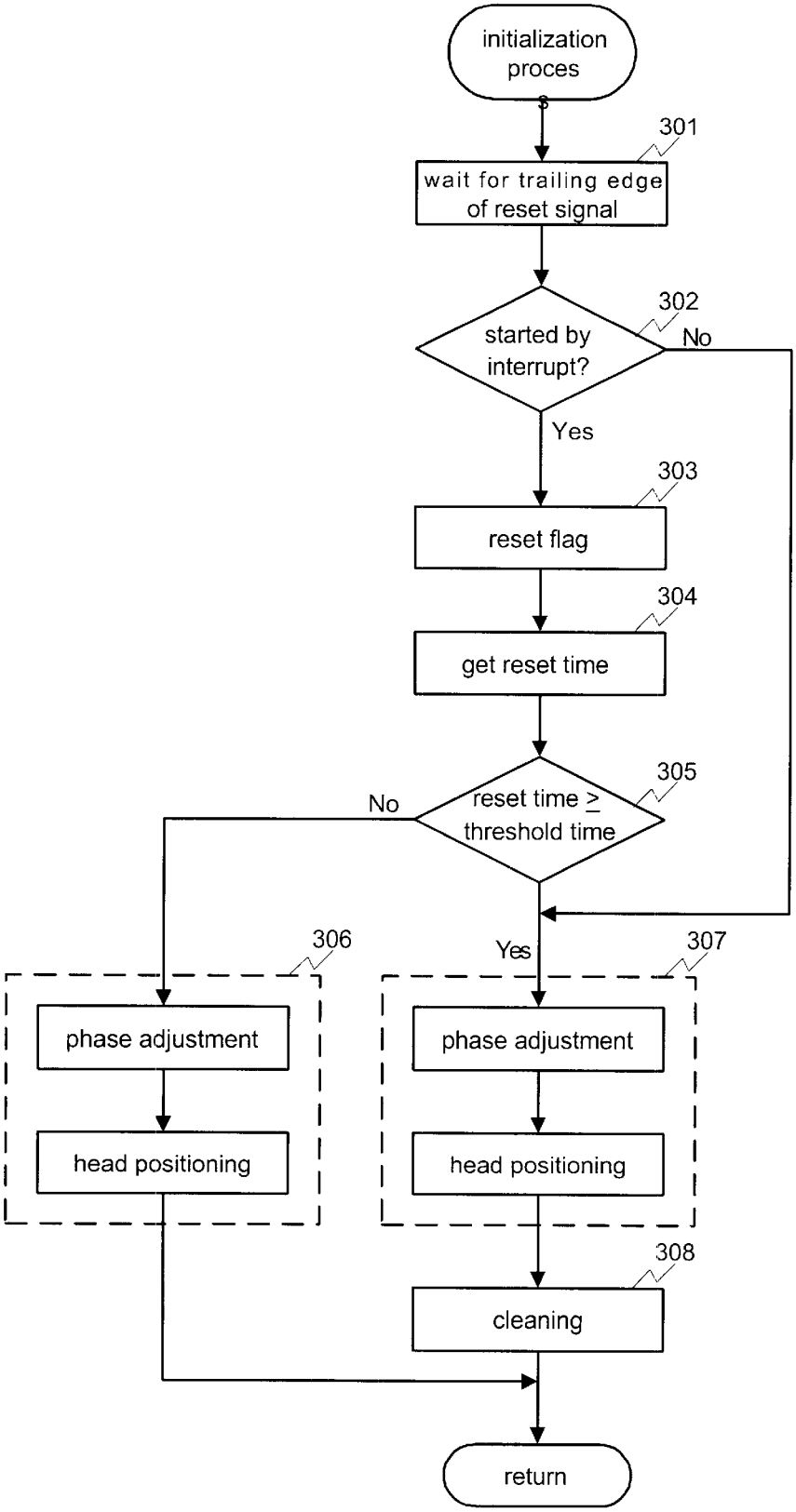
FIG. 3 is a flow chart of a process for controlling the performance of initialization processes according to a first preferred embodiment of the present invention.

FIG. 3 is a flow chart of a process for controlling the performance of particular initialization process(es) according to the present invention. After having returned from the interrupt routine of FIG. 2 and having received the internal reset signal Vr, the CPU 103 waits for the trailing edge of the reset signal Vr, i.e., it waits for the reset signal to assume its inactive state (step 301). It should be noted that in the present embodiment, the active state of the reset signal Vr is a low potential state while the inactive state is a high potential state. Hence, when the leading edge of the reset signal Vr is due to a switching off of the host 120, the trailing edge will not occur until after the host 120 is switched on again and ready to send (plus the delay by delay circuit 113). Thus, if a reset signal from the host computer 120 is received, the CPU 103 waits until the host 120 is ready to send a control command. If the printer 101 power is turned on, the CPU 103 waits for the trailing edge of the power on reset signal. Next, the CPU 103 detects whether the process was initiated due to an interrupt (step 302). In this exemplary embodiment, the CPU 103 detects whether the external reset flag is set in flash ROM 108.

If the process is initiated due to an interrupt, that is, the external reset flag is set (step 302 returns yes), the flag is reset in step 303. The current time, that is, the time of the trailing edge of the reset signal is then read from the RTC 107, the time of the leading edge of the reset signal stored in flash ROM 108 is read, and the active time of the reset signal is calculated from these two time values (step 304). This reset signal active time is referred to below as the "reset time". It will be appreciated that in the present embodiment the reset start time is the time at which the leading edge of reset signal Vrst is detected while the reset end time is the time at which the trailing edge of the delayed reset signal Vr is detected. Thus, the "reset time" does in fact represent the duration of the active state of the reset signal plus the delay time by the delay circuit 113. Since the delay time is a known constant it may either be subtracted from the calculated value or considered in a correspondingly longer threshold value which is explained below. For ease of explanation the following description assumes that the reset time is the true reset time between the leading and trailing edges of both of the reset signal Vrst and the reset signal Vr.

In step 305 it is determined whether or not the reset time is greater than or equal to a specific threshold time. If not (step 305 returns no), then the interrupt is determined to be a short interrupt (i.e., the reset time is short), and it is therefore determined that head cleaning is not necessary. In this situation, a first initialization process is performed (step 306), after which the general initialization routine ends, and control proceeds in accordance with normal printing operations. In this exemplary embodiment, the first initialization process comprises the operations of adjusting the phase of the stepping motor 110 or 112 and positioning the print head 109.

If the reset time is greater than or equal to the threshold time (step 305 returns yes), then the interrupt is determined to be a long interrupt (i.e., the reset time is long) and head cleaning is therefore necessary. This occurs, for example, when the printer 101 power remains on while the host 120 has been turned off and later turned on again. In this case, the first initialization process is performed (step 307), followed by the execution of a second initialization process (step 308), after which the general initialization routine ends, and control proceeds in accordance with normal printing operations. In this exemplary embodiment, the second initialization process comprises the cleaning the print head 109.

The specific threshold time can be 10 seconds, for example, but can also be defined as desired based on the specific application as well as on the requirements and usage of the printer 101.

If the general initialization process is initiated for a reason other than an interrupt and step 302 therefore returns no, the procedure skips forward to step 307, and the initialization process selected for a power on reset operation is performed. Typical non-interrupt events which may trigger the general initialization process include the printer power being turned off before a reset signal is received from the host 120 and then being turned on again.

It should be noted that step 302 is not always necessary. For example, when printer power is turned on again, the trailing edge time of the last reset signal is usually relatively old and the reset time will therefore typically exceed the specific threshold time, causing step 307 to always be performed when printer power is turned on. However, including step 302 makes it possible to more precisely control what particular initialization process(es) is/are to be performed based on what caused the start of the general initialization process. Both variations are therefore included within the scope of the present invention.

Figure 4:
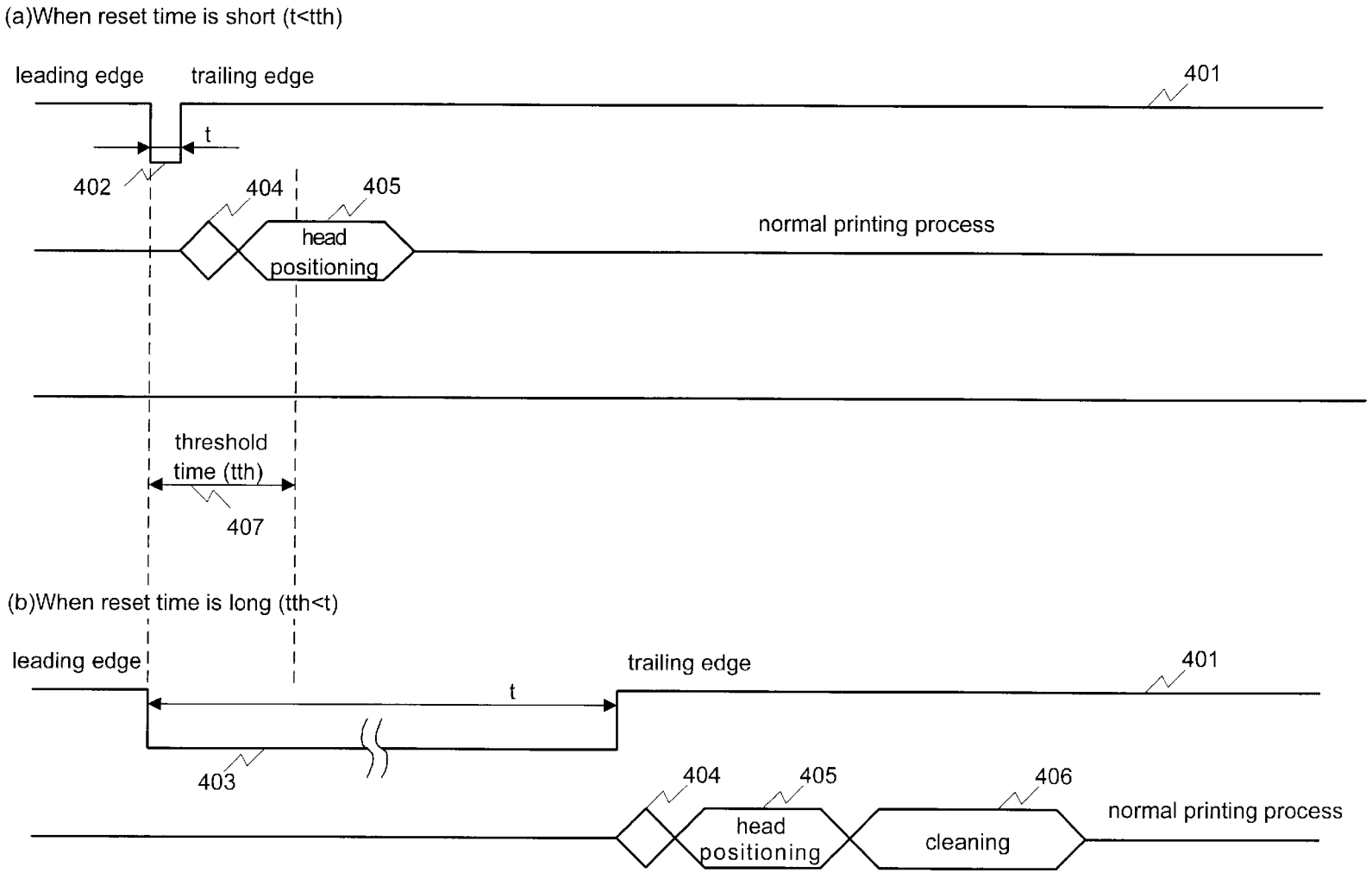
FIG. 4 is a timing chart showing how the reset signal is used to control which of the specific initiation processes are to be performed when a printer according to the present invention receives the reset signal.

FIG. 4 is a timing chart used to describe the processes performed when a printer according to the present invention receives a reset signal. Two reset signal lines 401 are shown, one with reset signal 402 and the other with reset signal 403. The drop in potential of reset signal 402 is the result of a reset signal sent by an application running on the host 120. The potential drop of reset signal 403 is the result of a reset signal sent in response to the host 120 power being turned off and on.

In response to reset signal 402 whose reset time is shorter than the specific threshold time, the printer 101 performs only the first initialization process, that is, phase adjustment 404 and head positioning 405. In response to reset signal 403 whose reset time is longer than the specific threshold time, the printer 101 performs both the first initialization process (phase adjustment 404 and head positioning 405), and the second initialization process (head cleaning 406).

By controlling the execution of the particular initialization processes (i.e., the first and second initialization processes) using the reset time of the reset signal, the number of times the second initialization process is performed can be reduced. As a result, ink consumption and operating costs can be reduced, and the time required for initialization can be shortened. In the exemplary embodiment, as shown in FIG. 4, the reset time is compared with threshold time (tth) 407, which determines the particular initialization process (es) to be performed.

Figure 5:
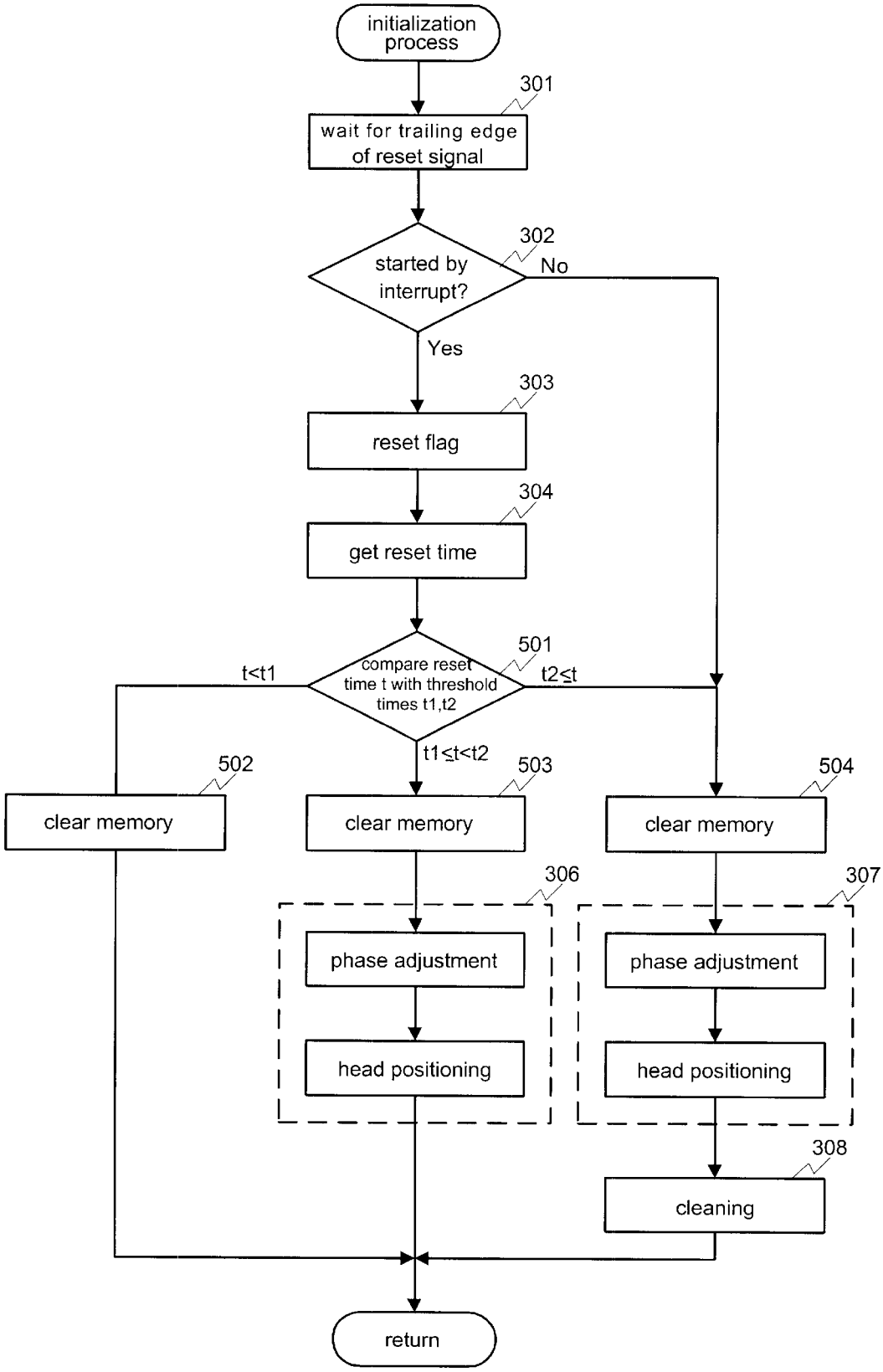
FIG. 5 is a flow chart of a process for controlling the performance of initialization processes according to a second preferred embodiment of the present invention.

FIG. 5 is a flow chart of a process for controlling the performance of particular initialization process(es) according to a second preferred embodiment of the present invention. This embodiment differs from the above-described first preferred embodiment in that a reset time t is compared with two threshold times (t1 and t2, where t1<t2) to determine which, if any, of the first and second initialization processes is/are to be performed based on this comparison. The process illustrated in FIG. 5 includes some of the same steps as the process shown in FIG. 3. Such steps are identified by like reference numerals, and further description thereof is omitted below.

After obtaining the reset time t in step 304, the reset time t is compared with threshold values t1 and t2 in step 501. If t is less than t1 (t<t1), all or part of the contents of the receive buffer, print buffer, an/or areas of the volatile memory RAM 106 in which printer settings are stored is cleared (step 502), and the general initialization process ends.

If t is greater than or equal to t1 but less than t2 (t1≦t<t2), memory is cleared as in step 502 (step 503), the first initialization process (stepping motor phase adjustment and print head positioning operations) is performed (step 306), and the general initialization process ends.

If t is greater than or equal to t2 (t2≦t), memory is again cleared as in step 502 (step 504), the first initialization process (stepping motor phase adjustment and print head positioning operations) is performed (step 307), the second initialization process (print head cleaning) is performed (step 308), and the general initialization process ends.

By using a plurality of threshold time values in selecting neither, only the first, or both of the initialization processes to be performed, it is possible to more precisely control initialization of printer 101. Unnecessary initialization process(es) can thus be eliminated, and printer throughput can be improved. The threshold time values and the initialization process(es) to be performed based on the reset time can be set by way of specific commands sent from the host 120. It is also possible for the host 120 to control the reset time and thereby control the initialization process(es) to be performed on the printer 101.

As demonstrated by the foregoing description, the present invention achieves the following benefits:

(1) A printer and a method of selectively controlling the execution of the initialization process(es) according to the length of a reset time of a reset signal sent from a host is provided. The reset time may be defined as the time from the beginning to the end, that is, from one pulse edge to the other pulse edge, of the reset signal.

(2) A printer and a printer control method whereby a cleaning process is not performed every time a reset signal is received but rather is performed only when necessary, that is, when the reset time is greater than a certain threshold time is provided. This is particularly advantageous when the printing mechanism of the printer is of the ink jet type and the cleaning process consumes much ink. In accordance with the invention, the cleaning process need only be performed as required and not simply every time the printer receives a reset signal which reduces ink consumption and printer operating cost. Also, high speed printing can be achieved by shortening the time required for initialization in response to reset signals frequently asserted by an application program running on the host.

(3) Media on which program(s) for controlling a printer in accordance with the invention is recorded and stored is provided. Such media embodying the control program(s) can be easily distributed and marketed as a software product separately from the printer. A printer and printer control methods according to the present invention can be achieved, and the above-noted benefits thus derived, by running the program(s) stored on such media.

While the invention has been described in conjunction with several specific embodiments, many further alternatives, modifications and variations will be evident to those skilled in the art in light of the foregoing description.

For example, the control methods of the described embodiments are by way of example only. The order of the steps can be changed or altered in various ways, and such equivalent embodiments are also included within the scope of the present invention.

Moreover, it will be apparent to one skilled in the art that while the preferred embodiments have been described in connection with an ink jet printing mechanism, the invention is not so limited. The invention can also be used with other types of printers, such as dot impact printers, laser printers, and thermal transfer printers. In any type of printer in which the invention is used, specific initialization processes that require much time to perform, that are not desirably performed too often, and/or for which it is not desirable to spend much time, may be included in the second initialization process described above. Specific initialization processes that need to be performed more often and/or which can be completed in a short time may be included in the first initialization process. Such variations are also included within the scope of the present invention.

Furthermore, although a real-time clock is used for measuring the reset time in the above preferred embodiments of the invention, it will be apparent to one skilled in the art that a counter or other circuit disposed externally to the CPU 103 can be used instead. For example, the reset time can be measured by supplying a specific clock signal to a counter, and supplying the reset signal from the host as a counter start (enable) signal.

Also, in the preferred embodiments, the reset signal and delayed reset signal from the host are described as being supplied to the nonmaskable interrupt and reset terminals respectively of the CPU. Alternatively, the reset signal can be supplied to a normal input terminal, in which case a delay circuit is not necessary.

In addition, if it is not necessary to discriminate the reset signal received from the host from the power-on reset signal of the printer, it is also not necessary to store the external reset flag.

Thus, the invention described herein is intended to embrace all such alternatives, modifications, applications and variations as may fall within the spirit and scope of the appended claims.

What is claimed is:

1. A printing apparatus having a printing mechanism for printing text or graphics based on commands and print data received from a host device, said printing apparatus comprising:

a controller that controls operation of the printing apparatus;

an interface adapted to receive at least one reset signal from the host device and transmit the reset signal to the controller; and a timer circuit that measures a duration of each reset signal received by the controller;

wherein the controller controls the performance of a plurality of initialization processes based on the duration of a respective reset signal.

2. The printing apparatus as set forth in claim 1, further comprising a comparator that compares the duration with at least one specific threshold time, and wherein the controller controls the performance of a plurality of initialization processes based on the result of the comparison by the comparator.

3. The printing apparatus as set forth in claim 2, wherein the plurality of initialization processes includes a first initialization process and a second initialization process, and wherein the controller causes the first initialization process to be performed when, based on the result of the comparison, the duration is less than a first specific threshold time, and causes the second initialization process to be performed when the duration is greater than or equal to the first specific threshold time.

4. The printing apparatus as set forth in claim 3, wherein the printing mechanism comprises a stepping motor, and wherein the first initialization process includes a process for adjusting a phase of the stepping motor.

5. The printing apparatus as set forth in claim 3, wherein the printing mechanism comprises a print head, and wherein the first initialization process includes a process for synchronizing the actual position of the print head with data in the controller representing the position of the print head.

6. The printing apparatus as set forth in claim 3, further comprising a memory that stores at least one of a plurality of printing apparatus settings, a command from the host device, or print data, and wherein the first initialization process includes a process for clearing part of all of the memory.

7. The printing apparatus as set forth in claim 3, wherein the printing mechanism comprises an ink jet print head, and wherein the second initialization process includes a process for cleaning the print head.

8. A printing apparatus as set forth in claim 3, wherein the plurality of initialization processes includes a third initialization process;

wherein the comparator compares the duration with a second specific threshold time less than the first specific threshold time; and wherein, based on the result of the comparison of the duration with the first and second specific threshold times, the controller causes a third initialization process to be performed when the duration is less than the second specific threshold time, causes the first initialization process to be performed when the duration is greater than or equal to the second specific threshold time and less than the first specific threshold time, and causes the second initialization process to be performed when the duration is greater than or equal to the first specific threshold time.

9. The printing apparatus as set forth in claim 8, further comprising a memory that stores at least one of a plurality of printing apparatus settings, a command from the host device, or print data;

wherein the third initialization process includes a process for clearing part or all of the memory.

10. The printing apparatus as set forth in claim 1, wherein the timer circuit comprises a real-time clock that measures the duration, and a delay circuit that delays the reset signal received from the interface for a specific time and supplies the delayed reset signal to the controller, and wherein the controller performs the selected initialization process, which is one out of the plurality of initialization processes selected according to the duration, in response to the delayed reset signal.

11. A method of controlling a printing apparatus having a printing mechanism for printing text or graphics based on commands and print data received from a host device, the method comprising the steps of:

(a) receiving a reset signal from the host device;

(b) measuring a duration of the reset signal received in step (a); and (c) controlling the performance of a plurality of initialization processes based on the duration measured in step (b).

12. The method as set forth in claim 11, further comprising the step of:

(d) comparing the duration with at least one specific threshold time; and wherein the performance of the plurality of initialization processes is controlled in step (c) based on the result of the comparison in step (d).

13. The method as set forth in claim 12, wherein the plurality of initialization processes include a first initialization process and a second initialization process, and wherein step (c) comprises performing the first initialization process when, based on the result of the comparison in step (d), the duration is less than a first specific threshold time, and performing the second initialization process when the duration is greater than or equal to the first specific threshold time.

14. The method as set forth in claim 13, wherein the first initialization process includes a process for adjusting a phase of a stepping motor in the printing mechanism.

15. The method as set forth in claim 13, wherein the first initialization process includes a process for synchronizing the actual position of a print head in the printing mechanism with data in a controller representing the position of the print head.

16. The method as set forth in claim 13, wherein the printing apparatus comprises a memory that stores at least one of a plurality of printing apparatus settings, a command from the host device, or print data, and wherein the first initialization process includes a process for clearing part or all of the memory.

17. The method as set forth in claim 13, wherein the second initialization process includes a process for cleaning a print head in the printing mechanism.

18. The method as set forth in claim 12, wherein step (d) comprises comparing the duration with a second specific threshold time less than the first specific threshold time; and wherein, based on the result of the comparison of the duration with the first and second specific threshold times, step (c) comprises performing a third initialization process when the duration is less than the second specific threshold time, performing the first initialization process when the duration is greater than or equal to the second specific threshold time and less than the first specific threshold time, and performing the second initialization process when the duration is greater than or equal to the first specific threshold time.

19. The method as set forth in claim 18, wherein the printing apparatus further comprising a memory that stores at least one of a plurality of printing apparatus settings, a command from the host device, or print data; and wherein the third initialization process includes a process for clearing part or all of the memory.

20. The method as set forth in claim 11, wherein step (a) comprises detecting a leading edge of the reset signal, wherein step (b) comprises:

(b)(1) reading from a real-time clock a current time at which the edge is detected in step (a) and storing it as a reset start time, (b)(2) delaying the reset signal received in step (a) for a specific time, (b)(3) detecting a trailing edge of the reset signal whose leading edge was detected in step (a) or of the delayed reset signal, (b)(4) reading, as a reset end time, from the real-time clock a current time at which the trailing edge is detected, and (b)(5) calculating the duration of the reset signal from the difference between the reset end time and the reset start time, and wherein step (c) comprises performing the selected initialization process, which is one out of the plurality of initialization processes selected according to the duration, in response to the delayed reset signal.

21. A device-readable medium embodying a program of instructions for controlling a printing apparatus having a printing mechanism for printing text or graphics based on commands and print data received from a host device, the method comprising the steps of:

(a) receiving a reset signal from the host device;

(b) measuring a duration of the reset signal received in step (a); and (c) controlling the performance of a plurality of initialization processes based on the duration measured in step (b).

22. The device-readable medium as set forth in claim 21, further comprising the step of:

(d) comparing the duration with at least one specific threshold time; and wherein the performance of the plurality of initialization processes is controlled in step (c) based on the result of the comparison in step (d).

23. The device-readable medium as set forth in claim 22, wherein the plurality of initialization processes include a first initialization process and a second initialization process, and wherein step (c) comprises performing the first initialization process when, based on the result of the comparison in step (d), the duration is less than a first specific threshold time, and performing the second initialization process when the duration is greater than or equal to the first specific threshold time.

24. The device-readable medium as set forth in claim 23, wherein the first initialization process includes a process for adjusting a phase of a stepping motor in the printing mechanism.

25. The device-readable medium as set forth in claim 23, wherein the first initialization process includes a process for synchronizing the actual position of a print head in the printing mechanism with data in a controller representing the position of the print head.

26. The device-readable medium as set forth in claim 23, wherein the printing apparatus comprises a memory that stores at least one of a plurality of printing apparatus settings, a command from the host device, or print data, and wherein the first initialization process includes a process for clearing part or all of the memory.

27. The device-readable medium as set forth in claim 23, wherein the second initialization process includes a process for cleaning a print head in the printing mechanism.

28. The device-readable medium as set forth in claim 22, wherein step (d) comprises comparing the duration with a second specific threshold time less than the first specific threshold time; and wherein, based on the result of the comparison of the duration with the first and second specific threshold times, step (c) comprises performing a third initialization process when the duration is less than the second specific threshold time, performing the first initialization process when the duration is greater than or equal to the second specific threshold time and less than the first specific threshold time, and performing the second initialization process when the duration is greater than or equal to the first specific threshold time.

29. The device-readable medium as set forth in claim 28, wherein the printing apparatus further comprising a memory that stores at least one of a plurality of printing apparatus settings, a command from the host device, or print data; and wherein the third initialization process includes a process for clearing part or all of the memory.

30. The device-readable medium as set forth in claim 21, wherein step (a) comprises detecting a leading edge of the reset signal, wherein step (b) comprises:

(b)(1) reading from a real-time clock a current time at which the edge is detected in step (a) and storing it as a reset start time, (b)(2) delaying the reset signal received in step (a) for a specific time, (b)(3) detecting a trailing edge of the reset signal whose leading edge was detected in step (a) or of the delayed reset signal, (b)(4) reading, as a reset end time, from the real-time clock a current time at which the trailing edge is detected, and (b)(5) calculating the duration of the reset signal from the difference between the reset end time and the reset start time, and wherein step (c) comprises performing the selected initialization process, which is one out of the plurality of initialization processes selected according to the duration, in response to the delayed reset signal.

31. A program of instructions for controlling a printing apparatus having a printing mechanism for printing text or graphics based on commands and print data received from a host device, the method comprising the steps of:

(a) receiving a reset signal from the host device;

(b) measuring a duration of the reset signal received in step (a); and (c) controlling the performance of a plurality of initialization processes based on the duration measured in step (b).

* * * * *